United States Patent [19]

Stump

[11] 4,148,207

[45] Apr. 10, 1979

[54] DRAWING TECHNIQUE

[75] Inventor: Paul E. Stump, Beaver Falls, Pa.

[73] Assignee: The Babcock & Wilcox Company, New York, N.Y.

[21] Appl. No.: 879,288

[22] Filed: Feb. 21, 1978

[51] Int. Cl.[2] ..... B21C 3/16
[52] U.S. Cl. ..... 72/283; 72/479
[58] Field of Search ..... 72/283, 478, 479

[56] References Cited

U.S. PATENT DOCUMENTS

| | | | |
|---|---|---|---|
| 2,183,861 | 12/1939 | Cotter, Sr. | 72/275 |
| 2,228,301 | 1/1941 | Ditzel et al. | 72/283 |
| 2,408,325 | 9/1946 | Luce et al. | 72/283 |
| 3,167,176 | 1/1965 | Hill et al. | 72/283 |

*Primary Examiner*—Michael J. Keenan
*Attorney, Agent, or Firm*—Joseph M. Maguire; Angelo Notaro

[57] ABSTRACT

A method and apparatus for improving the interior or exterior surface smoothness of a tube shell during cold draw operations is disclosed wherein the final reduction of the tube shell is completed within the die land.

11 Claims, 3 Drawing Figures

DRAWING TECHNIQUE

BACKGROUND OF THE INVENTION

The invention relates to a method of manufacturing tubing and, more particularly, to an improved method and apparatus for increasing the inside or outside smoothness of cold drawn tubing that is drawn through a fixed die with an internal stationary mandrel plug disposed therewithin.

The cold drawing of tubes often involves the drawing of hot rolled tubular shells through a fixed die. The diameter and wall thickness of the tube shell are typically larger than the same dimensions of the finished tube. Simultaneous wall and diameter reductions may be achieved, moreover, by drawing the tube shell through a die opening, into which a cylindrical mandrel plug, fixed to a mandrel rod which holds it in a pre-set position, is inserted. The die opening, typically smaller than the outside diameter of the tube shell which is to be cold drawn, is generally provided with a bell shaped or conical shaped entrance or approach zone leading to a circular die land or bearing section. An annulus forms between the mandrel plug and the die opening. As the tube shell passes through the annulus its internal surface contacts a working surface on the mandrel plug and its external surface contacts the working surface of the die.

The outer diameter of the tube shell will be reduced to the diameter of the die land as it passes through the conical approach zone. The inner diameter of the tube shell is reduced simultaneously with its outer diameter, with little or no reduction of the wall thickness, until the inner surface of the tube shell contacts the cylindrical surface of the internally disposed mandrel within the conical approach zone. Thereafter, the inner diameter of the tube shell is essentially constant but the thickness of the wall decreases along with the outer diameter until entry into the die land. There is no further wall reduction after the shell enters into the die land. Excess metal due to the reduction in cross-section causes the length of the tube to increase. The cross section of the tube passing from the die opening is approximately equal to the cross section of the annulus within the die land.

The quality of the tube shell has considerable bearing upon the quality of the finished tube. It is essential, therefore, that the surfaces of the shell be free of defects such as seams and slivers to preclude the development of surface imperfections, pitting and unacceptable surface roughness in the drawn tube, particularly in tubular applications such as for hydraulic cylinders. Tube shells having defects may be properly conditioned by means of local or complete grinding of the surfaces of the shell. This necessitates additional labor intensive steps such as boring the inside surface of the shell or turning down the outside surface and results in the need to compensate for metal removed during boring or turning operations, or both.

SUMMARY OF THE INVENTION

An improved method and apparatus of cold drawing a tube shell to be worked so as to increase the exterior or interior smoothness of the drawn tube is presented.

A tube shell is positioned within a die opening having, in one embodiment, an approach zone and a cylindrical die land. The interior of the tube shell is contacted within the die opening with a mandrel having a first cylindrical working section angularly joined, in a preferred embodiment by a frusto-conical section, to a second smaller cylindrical working section. The mandrel is fixed in position within the tube shell and within the die with the first cylindrical working section adjacent to the exit side of the die opening. The tube shell is axially drawn through the die opening to reduce its inner and outer diameters and thickness. A final reduction in thickness is completed within the die land portion of the die opening.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
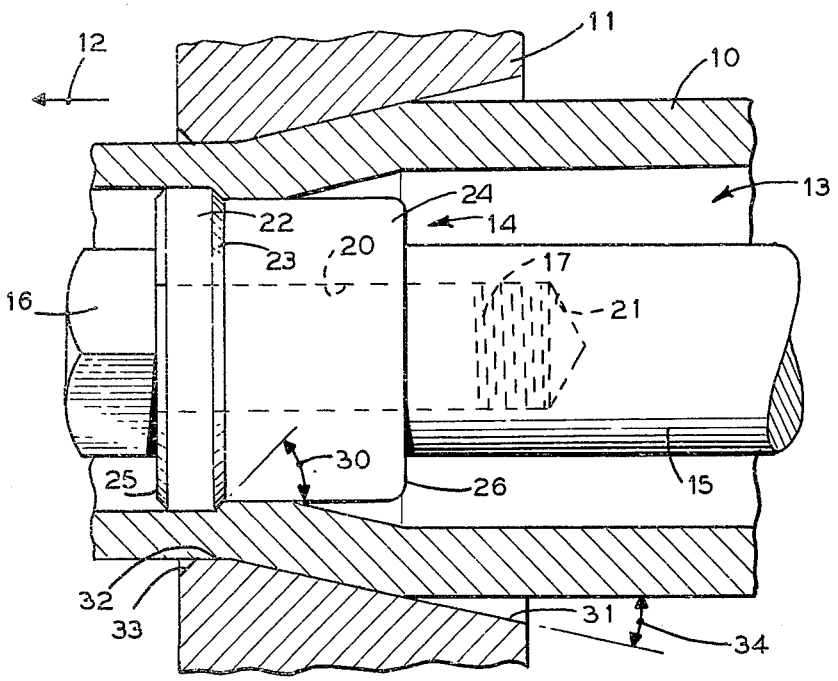
FIG. 1 is a side view, partly in section, of a tube shell, die and mandrel construction in accordance with the invention.

FIG. 1 illustrates a tube shell 10 being axially drawn through a fixed die 11 in the direction of arrow 12 by well known means (not shown) such as a draw carriage. A stationary mandrel 13 is disposed within the tube shell 10.

The mandrel 13 has a mandrel plug 14, constructed in accordance with the principles of the invention, fastened to a mandrel rod 15 by a retaining bolt 16 having a threaded end 17 that passes through a central longitudinal bore 20 in the plug 14 and threadably engages a threaded recess 21 in the end of the mandrel rod 15. The mandrel plug 14 of the preferred embodiment has stepped working surfaces including a larger diameter cylindrical working section 22 angularly joined to a smaller diameter cylindrical working section 24 by a frusto-conical section 23. The section 23 has an angle 30 of inclination with respect to the longitudinal axis of the plug. The leading end 25 of the plug 14 is on the larger working section 22 and is beveled in the preferred embodiment, as is known in the art, to facilitate positioning of the plug 14 within the tube shell 10. The trailing end 26 of the plug 14 is on the smaller diameter working section and abuts the mandel rod. In the preferred embodiment, each section 22, 23, 24 of the plug 14 has a common central longitudinal axis.

The die 11 is provided with a die opening which includes a conical approach zone 31, a cylindrical die land 32, and a countersunk exit or relief zone 33 at the exit side of the die opening and, as represented in FIG. 1, is conventional. The conical approach zone has a half-angle 34 relative to the axis of the die opening. The longitudinal axis of the tube shell 10 is parallel, and preferably coaxial, with the axis of the die opening.

In operation, the tube shell 10 is positioned within the die opening and the mandrel plug 14 is held fixed in position within the die and the tube shell 10.

Figure 2:
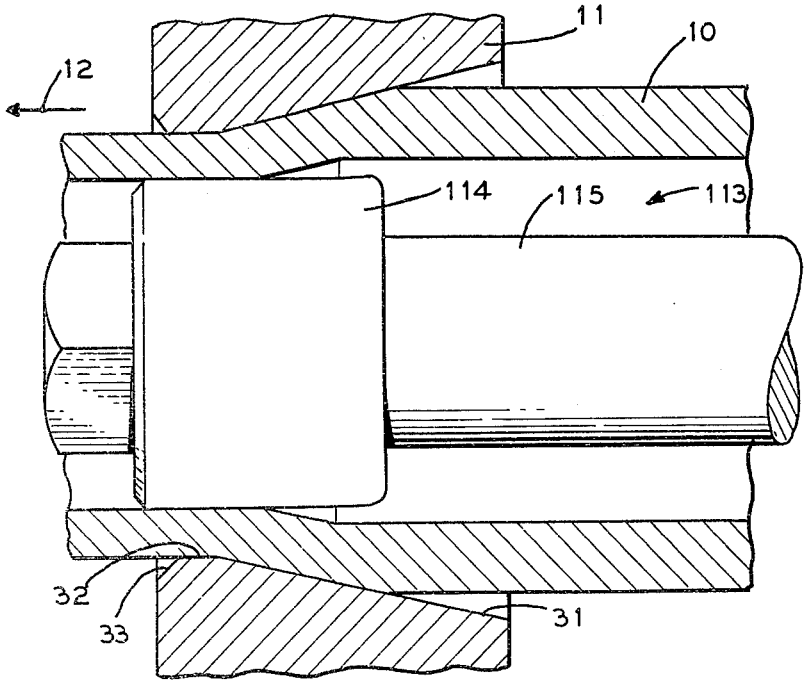
FIG. 2 (PRIOR ART)
FIG. 2 is a side view, partly in section, of a conventional tube shell, die and mandrel arrangement.
Figure 3:
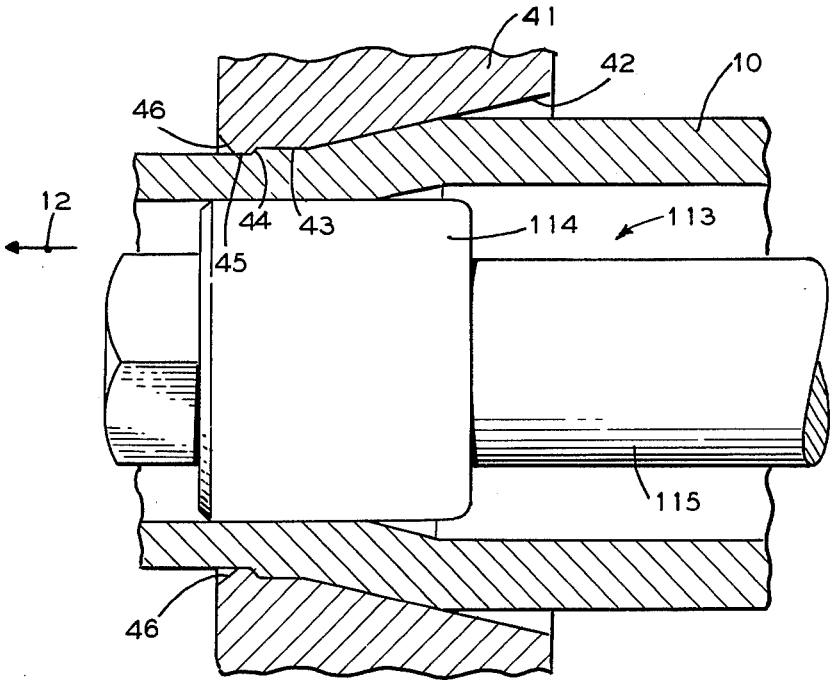
FIG. 3 is a side view, partly in section, of a tube shell, die and mandrel construction in accordance with an alternative embodiment of the invention.

As shown, the exterior surface of the tube shell contacts the surface of the die opening, and the interior surface of the shell contacts the mandrel plug. The tube shell 10 is axially drawn through the die opening by conventional means in the direction of arrow 12 to cold work the shell. FIG. 2 is respresentative of a similar cold working operation using a conventional mandrel 113 including a cylindrical mandrel plug 114 fastened to a mandrel rod 115, and fixed within the die 11. As illustrated in both FIGS. 1 and 2, diametrical (inner and outer) reduction of the tube shell 10 commences as the tube shell 10 comes into contact with the surface of the conical approach zone 31. Reduction of the outer diameter continues as the tube shell 10 passes through the conical approach zone 31, but reduction of the inner diameter ceases, and reduction of the wall thickness is initiated, when the inner surface of the shell contacts the mandrel plug—in the case of the inventive plug, at the smaller diameter working surface (24) (see FIG. 1). In the prior art, as illustrated in FIG. 2, the inner diameter of the moving tube shell 10 remains essentially unchanged after contacting the plug 114. As best shown in FIG. 1, however, the tube shell 10, in accordance with the invention, is reduced to its final inner diameter and wall thickness dimensions within the cylindrical die land 32 upon traversing the frusto-conical section 23 and contacting the larger diameter working section 22.

It has been found that the smoothness of the inner surface of a tube cold drawn with a stepped mandrel, as described, is improved. As the tube shell 10 passes over the frusto-conical section, the inner diameter is expanded forcing the tube material radially outward. The combination of selective metal working at the inner surface and radial compression work to produce an improved smoothing on the inner surface. Thus, any surface roughness on the inner surface of an ingoing tube shell, such as would normally be present in a hot finished seamless tube, would be greatly diminished, if not completely eliminated. In contrast, appreciable roughness would remain on the inner surface of a hot finished tube drawn with a conventional mandrel plug having a constant diameter cylindrical plug.

The following example exemplifies, the details of a tube drawn with a mandrel constructed in accordance with the invention:

EXAMPLE I

A steel tube shell having an outside diameter of 5.500-inches and a wall thickness of 0.600-inches was cold drawn to a tube heating an outer diameter of 5.000-inches and a wall thickness of 0.512-inches. The initial surface roughness of the inner surface of the tube shell ranged from 250 to 300 RMS microinches. The resulting inside surface roughness ranged between 20 and 30 RMS microinches. The surface resulting with the use of a conventional cylindrical mandrel to produce the same finished tube size would have been approximately 100 RMS microinches. The mandrel plug utilized has the following dimensions:

Section (22) Diameter—3.976-inches
Section (24) Diameter—3.956-inches
Angle (30)—45-degrees Smoother surfaces may be achieved, moreover, for a given wall reduction by subjecting the tube shell to multiple draw passes in order to incrementally reach the utimately desired wall reduction.

As used in the specification and claims, the term "working section" shall be understood as capable of imparting cold work to a tube being drawn in contact with a surface portion of the working section.

The embodiments of the invention in which an exclusive property or privilege is claimed are defined as follows:

1. An improved method of cold drawing a tube shell to be worked through an apparatus having a die opening provided with an approach zone and a cylindrical die land which comprises: positioning the tube shell within the die opening; contacting the exterior of the tube shell with at least part of the surface of the die opening; contacting the interior of the tube shell within the die opening with a mandrel plug having a first cylindrical working section disposed within the tube shell within the die land and angularly joined to a second smaller cylindrical working section disposed within the tube shell at least partly within the die land, the first cylindrical working section being further disposed on the exit side of the die opening; and axially drawing the tube shell to reduce its diameters and thickness.

2. In an apparatus for cold drawing tubes having a die opening provided with an approach zone and a cylindrical die land, means for axially drawing a tube shell to be worked through the die opening, an internal mandrel plug, and means for internally fixing the mandrel plug within the tube shell and the die opening, the improvement which comprises a mandrel plug having a first cylindrical working section angularly joined to a second cylindrical working section of smaller diameter, the mandrel plug being disposed in a fixed operating position within the die opening with the first working section adjacent to the exit side of the die opening, and the joint of the section being disposed within the die land such that completion of the reduction of the inner surface of the tube shell as it is axially drawn is effected within the die land.

3. An improved mandrel plug according to claim 2, wherein the first cylindrical working section is joined to the second cylindrical working section by a frusto-conical section.

4. An improved mandrel plug according to claim 2, wherein the first cylindrical working section and the second cylindrical working section have a common central longitudinal axis.

5. An improved mandrel plug according to claim 3, wherein the first cylindrical working section, the section cylindrical working section, and the frusto-conical section have a common central longitudinal axis.

6. In a tube drawing mandrel of the type having a mandrel plug fastened to a mandrel rod of smaller cross section, the improvement which comprises a mandrel plug having a first cylindrical working section angularly joined to a second cylindrical working section of smaller diameter, means for fastening the mandrel plug to the mandrel rod, the plug being fixedly attached to the mandrel rod by the fastening means such that the second cylindrical working section is disposed with one end abutting the mandrel rod.

7. The improvement according to claim 6, wherein the first cylindrical working section is joined to the second cylindrical working section by a frusto-conical section.

8. An improved method of cold drawing a tube shell to be worked through an apparatus having a die opening provided with an approach zone and a cylindrical die land which comprises: positioning the tube shell within the die opening; contacting the exterior of the tube shell with at least part of the surface of the die opening; contacting the interior of the tube shell within the die opening with a mandrel plug having a first cylindrical working section disposed within the tube shell at least partly within the die land and angularly joined to a second smaller cylindrical working section disposed within the tube shell at least partly within the die land, the first cylindrical working section being further disposed on the exit side of the die opening; and axially drawing the tube shell to reduce its diameters and thickness.

9. An improved method of cold drawing a tube shell to be worked through an apparatus having a die opening provided with an approach zone and a cylindrical die land which comprises: positioning the tube shell within the die opening; inserting a mandrel plug, within the tube shell at least partly within the die opening, of the type having a first cylindrical working section angularly joined to a second smaller cylindrical working section by a frusto-conical section such that the first cylindrical working section is disposed at the exit side of the die opening and the frusto-conical section is within the die land; and axially drawing the tube shell through the die opening by progressively contacting the exterior of a portion of the tube shell with at least part of the surface of the conical section to thereby reduce its diameters, next contacting the interior of the tube shell with the second cylindrical working section while continuing to contact the exterior of the tube with the conical section to reduce the thickness and outer diameter of the portion of the tube shell, and then contacting the interior surface of the portion of the tube shell within the die land with the frusto-conical section while concurrently contacting the exterior with the die land to reduce the thickness of the portion of the tube shell without further reduction of the outer diameter.

10. The improvement according to claim 6, wherein the first cylindrical working section and the second cylindrical working section have a common central longitudinal section.

11. The improvement according to claim 7, wherein the first cylindrical working section, the second cylindrical working section, and the frusto-conical section have a common longitudinal axis.

* * * * *